United States Patent [19]

Vacanti

[11] Patent Number: 4,991,230

[45] Date of Patent: Feb. 12, 1991

[54] SHOCK ABSORBING BODY PROTECTIVE PADS

[76] Inventor: Eugene J. Vacanti, Edina, Minn.

[21] Appl. No.: 398,658

[22] Filed: Aug. 25, 1989

[51] Int. Cl.[5] ..... A41D 13/00

[52] U.S. Cl. ..... 2/2; 2/45; 2/DIG. 3; 128/846

[58] Field of Search ..... 128/845, 846, 873, 874, 128/95.1, 96.1, 99.1, 100.1, 106.1, 109.1, 111.1, 82; 2/2, 22, 23, 24, 44, 45, 414, 92, DIG. 3

[56] References Cited

U.S. PATENT DOCUMENTS

| | | | |
|---|---|---|---|
| D. 277,805 | 3/1985 | Vacanti | D29/10 |
| D. 277,806 | 3/1985 | Vacanti | D29/10 |
| D. 277,807 | 3/1985 | Vacanti | D29/10 |
| D. 278,279 | 4/1985 | Vacanti | D29/10 |
| D. 280,145 | 8/1985 | Vacanti | D29/10 |
| D. 280,250 | 8/1985 | Vacanti | D29/10 |
| 1,602,454 | 10/1926 | Riddell | 2/23 |
| 1,784,148 | 12/1930 | Levinson | 2/2 |
| 1,991,721 | 2/1935 | Becket et al. | 2/2 |
| 2,609,537 | 9/1952 | Pfaff | 2/22 |
| 3,044,075 | 7/1962 | Rawlings | 2/22 |
| 3,248,738 | 5/1966 | Morgan | 2/2 |
| 3,431,133 | 3/1969 | Braude et al. | 428/283 |
| 3,487,417 | 12/1969 | Morgan | 2/413 |
| 3,507,727 | 4/1970 | Marshack | 156/153 |
| 3,547,765 | 12/1970 | Snyder et al. | 428/252 |
| 3,550,159 | 12/1970 | Alarco | 2/2 |
| 3,995,320 | 12/1976 | Zafuto | 2/2 |
| 4,266,298 | 5/1981 | Graziano | 2/22 |
| 4,370,754 | 2/1983 | Donzis | 2/22 X |
| 4,422,183 | 12/1983 | Landi et al. | 2/2 |
| 4,455,684 | 6/1984 | Johnson | 2/2 |
| 4,484,360 | 11/1984 | Leighton et al. | 2/22 |
| 4,484,361 | 11/1984 | Leighton et al. | 2/24 |
| 4,486,901 | 12/1984 | Donzis | 2/2 |
| 4,512,037 | 4/1985 | Vacanti | 2/2 |
| 4,513,449 | 4/1985 | Donzis | 2/22 X |
| 4,525,875 | 7/1985 | Tomczak | 2/2 |
| 4,538,301 | 9/1985 | Sawatzki et al. | 2/2 |
| 4,547,919 | 10/1985 | Wang | 5/455 |
| 4,566,137 | 1/1986 | Gooding | 2/413 |
| 4,602,385 | 7/1986 | Warren | 2/2 |
| 4,610,034 | 9/1986 | Johnson | 2/2 |
| 4,642,814 | 2/1987 | Godfrey | 2/2 |
| 4,700,403 | 10/1987 | Vacanti | 2/22 X |

FOREIGN PATENT DOCUMENTS

| | | | |
|---|---|---|---|
| 2823370 | 12/1979 | Fed. Rep. of Germany | 2/2 |
| 3530397 | 3/1987 | Fed. Rep. of Germany | 2/2 |
| 1503483 | 3/1978 | United Kingdom | 2/2 |

*Primary Examiner*—Robert A. Hafer
*Assistant Examiner*—Kevin G. Rooney

[57] ABSTRACT

Shock absorbing body protective pads for use by athletes in contact sports and comprising a pair of heat sealable woven scrim-reinforced plastic film members sealed together to form a plurality of cooperating and interconnected chamber elements therebetween. Each chamber element contains a foam pad constrainably retained within the chamber, and with the interior volume of at least two of the chamber elements being interconnected. A plurality of rigid tubular exhaust ports are arranged to communicate between the chambers and the ambient, with the exhaust ports being disposed along the lateral edges of certain of the chambers, and with these exhaust ports being arranged in oppositely disposed relationship, one to another, so as to insure continued communication with the ambient.

2 Claims, 2 Drawing Sheets

51
52
74

6
66
56
56
51
57
67
68
58
60
63
70
54
61
55
59
69
62
64
71
50
53
72

SHOCK ABSORBING BODY PROTECTIVE PADS

BACKGROUND OF THE INVENTION

The present invention relates generally to an improved shock absorbing body protective pad for use by athletes in contact sports, and more particularly to such body protective pads which are designed to provide protection against single impacts, as well as multiple and sudden impacts such as are frequently occasioned in contact sports such as hockey, football, soccer, and the like. The body protective padding of the present invention is designed to function and/or address a wide range of energy or impact loading which may occur within a single pad designed for use in various contact sports.

In the past, various techniques have been employed for the fabrication of body protective pads for use by athletes, with such pads frequently employing shock absorbing material such as foam, rubber, or other resilient-compressible materials. More recently, body protective pads have been designed for use by athletes and other competitors in sports, which employ superimposed plastic film members which retain synthetic resinous foam pads within chambers formed in the padding. While such devices have proven to be helpful and useful by athletes in contact sports, some additional features have been found to provide a greater degree of protection and a greater degree of comfort for the wearer-user.

SUMMARY OF THE INVENTION

In accordance with the present invention, therefore, a shock absorbing body protective pad has been designed which is prepared from a pair of heat sealable plastic film members which are arranged in generally superimposed relationship, one to another, and which are sealed along their edges and transversely of the edges to form a plurality of cooperating and interconnected chambers. Each of the individual chambers is filled with a foam pad element, particularly such a foam pad element which is of open-cell structure, and more particularly is of reticulated open-cell structure. Certain specific of the mutually adjacent chambers are coupled together so as to collectively define a pad segment, with the interconnecting port between the individual chambers being a non-sealed segment along a chamber divider seam. In order to accommodate air transfer and/or flow outwardly of the chambers, a plurality of generally rigid tubular members are inserted along the outer seams to form exhaust ports therein, the exhaust ports in turn communicating between the interior of the chamber and the ambient. In order to provide continuity of exhaust between the chamber and the abmient, and to reduce the tendency of the reticulated open-cell foam to block the open cross-section of the rigid tube member, the interior end of the tube is cut at an acute angle to the tubular axis. The system of the present invention is capable of functioning within three fundamental categories of energy-absorbing requirements including high impact, moderate impact, and low impact. The high impact devices address situations wherein concentrated and maximum energy are involved, along with an appropriate dispersion of the impact, and as such deals principally with objects of moderate to relatively large mass, and traveling at moderate to high speeds. A moderate impact area, on the other hand, deals with masses traveling at speeds ranging from average or moderate, with the low impact area addressing relatively smaller mass and masses traveling at high speeds.

The padding system of the present invention incorporates at least two energy dispersing chambers, which may be characterized as pads and or compartments, with these chambers being coupled together and controlled by a valve system which permits energy absorption through means of a closed, internal, or quasipneumatic (hydraulic) action. In this arrangement, therefore, the inter-chamber valving provides communication between chambers, and additional valving provides communicaiton with the atmosphere. This arrangement permits a prearranged or predetermined energy dispersment in accordance with the parameters of a previously established matrix relating to one of the three impact categories described above, specifically high, moderate or low.

Another feature of the invention and for the accomplishment of these objectives is the utilization of heat sealable plastic film which is bonded or laminated to one surface a layer of woven scrim. This scrim material is designed to be in contact with the body of the wearer, and provides a more flexible, non-adhering surface which aids in comfort for the wearer, and furthermore provides for relative movement between the surface of the shock absorbing pad and the skin of the wearer.

OBJECTS

Therefore, it is a primary object of the present invention to provide an improved shock absorbing body protective pad for use by athletes engaged in contact sports, and comprising a pair of heat sealable plastic film members sealed together to form a plurality of individual cooperating and interconnected chambers, and with each of the chambers being vented to accommodate air flow therebetween, and with the chambers being filled with an open-cell foam pad.

It is yet a further object of the present invention to provide an improved shock absorbing body protective pad for use by athletes engaged in contact sports comprising a pair of heat sealable plastic film pads sealed together to form a unitary structure with a plurality of cooperating and interconnected chambers therealong, and wherein vent means are provided between certain selected chambers, and futhermore wherein exhaust ports are formed of generally rigid tubular material and disposed along the outer edges of the chambers to communicate with the ambient, and to provide for appropriate air transfer inwardly and outwardly of the chamber.

Other and further objects of the present invention will become apparent to those skilled in the art upon a study of the following specification, appended claims, and accompanying drawings.

DESCRIPTION OF THE PREFERRED EMBODIMENT

In accordance with the preferred embodiment of the present invention, and with particular attention being directed to FIGS. 1–4 of the drawings, the shock absorbing body protective pad structure generally designed 10 comprises a pair of heat sealable plastic film members 11 and 12 arranged in generally superimposed relationship, one to the other, and having edge seals arranged therearound as at 13, and a plurality of transverse seals as at 14, 15, 16, and 17, so as to define and create a plurality of individual chambers therealong. The individual chambers are shown as at 19, 20, 21, 22, and 23. The plurality of chambers are arranged in cooperative and interconnected relationship, one to another, and have contours defining the body protecting needs of the wearer. Collectively, the individual heat sealable film members and chambers define an integral body protective pad such as pad arrangement 10.

Each of the chambers 19–23 inclusive is filled or loaded with a foam pad as at 25, for example. The foam pad is preferably of open-cell construction, and more specifically of open-cell reticular construction. The pad occupies the interior volume of its respective chamber, and is designed so that it has a volume equal to the volume of the chamber it occupies.

Certain of the individual chambers are interconnected, one with another, with these interconnections being shown, for example, at 27, 28, 29 and 30. These interconnections 27–30 inclusive, provide a means for the individual chambers to be in communication, one with another, and which these port means being formed by non-sealed together areas of the individual transverse seals 14 and 17 respectively.

In addition to the interconnecting ports, a plurality of generally rigid tubular exhaust ports are utilized in the device, with such tubular exhaust ports being shown at 32, 33, 34, 35, 36 and 37A. These tubular exhaust ports are disposed along the lateral edge surfaces of certain of the chambers, and are sealably engaged and retained into the overall structure. In this arragement, therefore, those chambers which communicate to atmosphere are fundamentally designed to be utilized, for the most part, to absorb low impact. In those cases where moderate impact is expected, the pad or area of the pad, through the valve system, will communicate with atmosphere as well as with one or more other interconnected chambers. This arrangement permits the pad to deal with a greater energy dispersement requirement. On those occasions where high impacts are expected, the size of the compartment may be increased, as well as the size of the interconnecting valves.

The valves, depending upon the design and requirement, will typically have sizes ranging from between one-sixteenth inch ID for low impact devices, up to about seven-sixteenths inch ID for high impact application. The compartment sizes and volumes of adjacent pads are determined upon the energy matrix requirements expected.

Figures 1, 2, 3, 4:
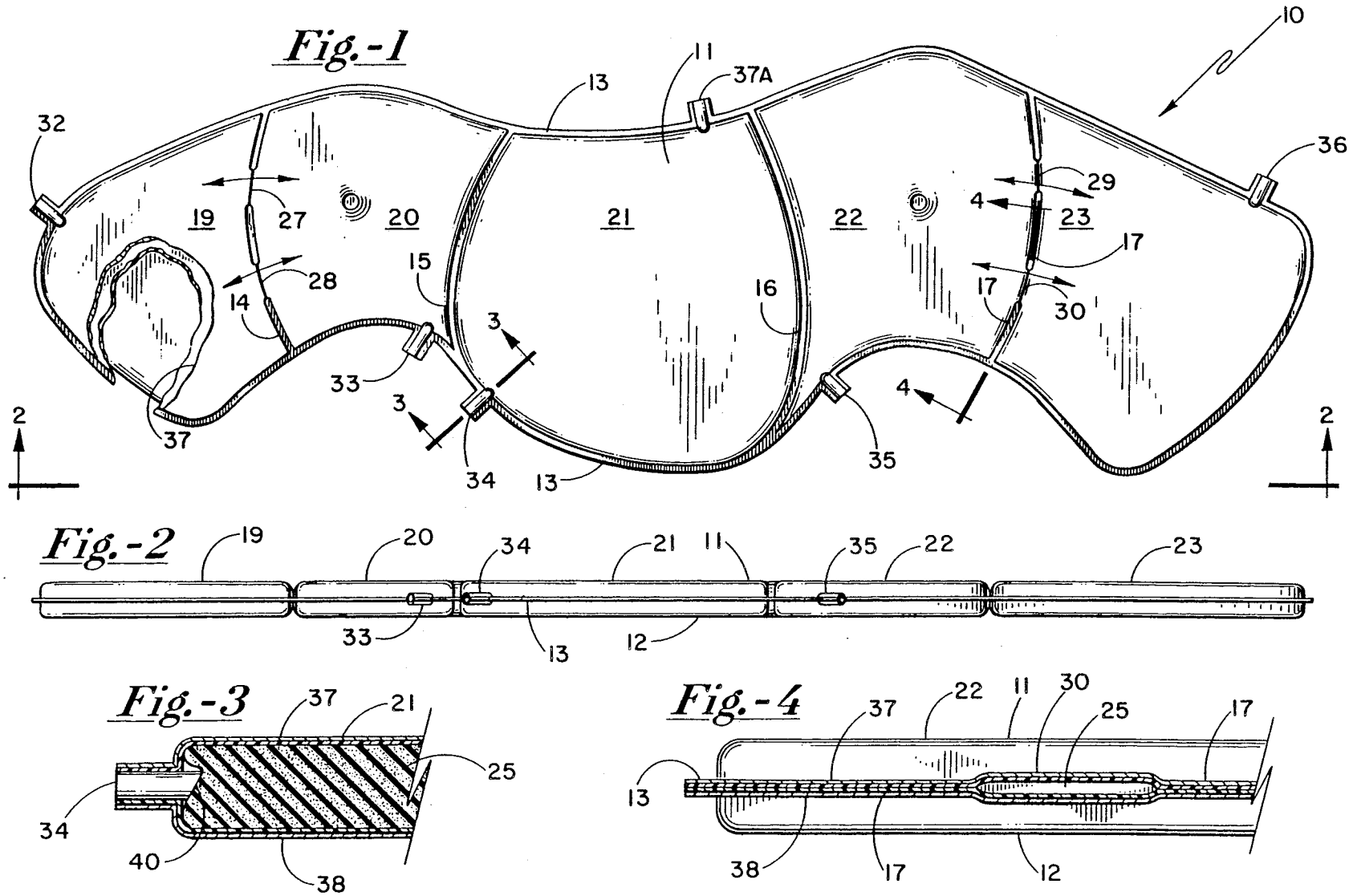
FIG. 1 is a top plan view of a shock absorbing body protective pad arranged in accordance with the present invention, and with the pad being particularly designed for use by hockey players.
FIG. 2 is a vertical plan view taken along the line and in the direction of the arrows 2—2 of FIG. 1.
FIG. 3 is a detailed sectional view, partially broken away, and taken on a slightly enlarged scale, with FIG. 3 being taken along the line and in the direction of the arrows 3—3 of FIG. 1.
FIG. 4 is a vertical sectional view taken between mutually adjacent chambers, and illustrating the configuration of the non-sealed zone forming a communicating port between adjacent chambers, with FIG. 4 being a fragmentary view taken on a slightly enlarged scale.

In order to enhance the functionality and wearability of the material, the film members 11 and 12 are formed as laminates, with the outer surfaces being in the form of scrim, such as is illustrated at 37 and 38 in FIG. 3. The scrim material is preferably a durable material such as a woven mixture of polyester and cotton, of 70/30 percent blend, and having a density of 0.7 ounce per square yard. In addition to the added comfort factor, the utilization of scrim material significantly improves the burst strength of the material, thus enhancing the utility and safety of the devices. Such scrim material is, of course, commerically available, as is the heat sealable plastic film component. In this connection, and specifically, the plastic portion of the material is an extruded vinyl fabric having a thickness of 10 mils.

With particular attention being directed to FIGS. 1 and 2 of the drawings, it will be noted that each of the individual tubular exhaust ports is arranged on an oppositely disposed relationship, one to the other, along the surfaces of the individual chambers. This arrangement is provided in order to more fully protect the wearer from body impacts, particularly when the wearer is struck with a force that is immediately adjacent to or directly upon the area of the exhaust port. With the oppositely disposed exhaust port configuration being employed, blockage of the individual cushioning members is rendered unlikely, and thus providing a more realiable and repeatable cushioning effect upon impact or application of force against the wearer.

As a further measure to protect the wearer from exhaust port blockage, the interior end of the individual exhaust port such as tubular exhaust port 34 is bias cut as at 40, with the bias cut being at an acute angle ranging from between 30° and 60° from the tubular axis. This arrangement, as discussed and as illustrated in the drawings, provides a small inner chamber or pocket which functions to reduce or eliminate blockage of the duct, thereby acting as a quasifloat-valve.

The design of the shock absorbing body protective pad illustrated in FIGS. 1–4 is arranged to permit the user to encounter multiple hits without causing full deflation of the assembly. The sizes of the chambers 19–23 is such that such deflation is rendered extremenly unlikely. The sizes of the interconnected 27–30 are approximately one inch in length each. By way of further example, the individual generally rigid tubular ports have an interior diameter of approximately one-eighth inch for most heavy contact sports such as hockey, with these tubes being fabricated from molded polyethylene having a wall thickness of approximately 1/32 inch. Tube sizes ranging as low as 1/32 inch and/or 1/64 inch are also possible, and may be used in certain applications. The larger tube size is desirable, particularly in heavy contact sports such as hockey, football and soccer in order to accommodate air flow inwardly and outwardly of the individual chambers and/or interconnected segments.

When fabricated in accordance with the present invention, and particularly in the embodiment shown in FIGS. 1–4 inclusive, the individual padding arrangement is designed so that impact against the wearer is absorbed by the body protective pad as a unit. The protective features are enhanced when the system is designed in this fashion.

With respect to the foam elements, as indicated, the foam elements are fabricated from open-cell reticulated foam. The foam has a density of preferably about 85 pounds per cubic foot, and for padding for hockey players, the foam is generally approximately 3/4-inch in thickness.

Figures 5, 6:
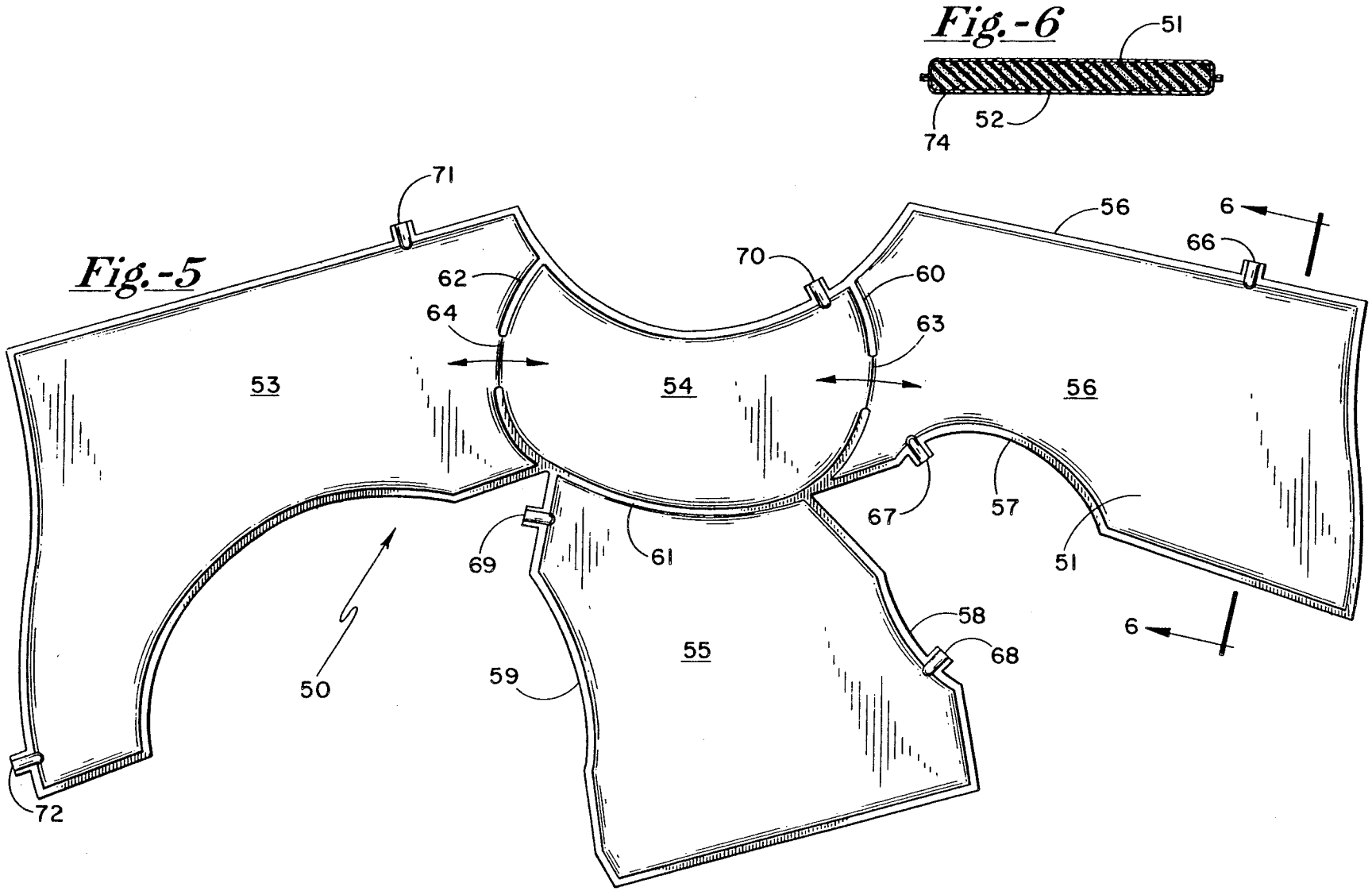
FIG. 5 is a top plan view of a shock absorbing body protective pad designed to protect the shoulder and neck area of the wearer, and being arranged in a slightly modified form from that shown in FIGS. 1—4.
FIG. 6 is a vertical sectional view taken along the line and in the direction of the arrows 6—6 of FIG. 5.

Attention is now directed to the structure illustrated in FIGS. 5 and 6, wherein body protective pad generally designated 50 includes a pair of heat sealable plastic film members 51 and 52, which are sealed together in the fashion illustrated and discussed in connection with the embodiment of FIGS. 1–4 inclusive. The embodiment of FIGS. 5 and 6 includes a plurality of cooperating and interconnected contoured chambers as at 53, 54, 55 and 56, with these chambers being formed by outer edge seals as at 58 and 59 respectively. Transverse seals separating individual chambers, one from another, are illustrated at 60, 61 and 62. Vents are formed in and along seals 60 and 62, with these vents being shown at 63 and 64 respectively. In addition, a plurality of generally rigid tubular exhaust ports are disposed in the structure as at 66, 67, 68, 69, 70, 71 and 72. As was the situation with the embodiment of FIGS. 1–4 inclusive, these exhaust ports are each designed to communicate between the interior of its respective chamber and the ambient, and is disposed along the lateral edge surfaces of certain selected chambers. Also, it will be noted that the exhaust ports are arranged in oppositely disposed realtionship, one to another, along the common chamber. Also, as was the case in the embodiment of FIGS. 1–4, the interior of each chamber is filled with open cell reticulated foam element as at 74. Other configurations and designed features of the embodiment of FIGS. 5 and 6 are similar to those discussed and disclosed in connection with the embodiment of FIGS. 1–4 inclusive.

The arrangement of the present invention provides an improved shock absorbing body protective pad for use by athletes engaged in contact sports, and is designed to provide protection against impact and forces applied to the body, and the arrangement further is designed to provide for unitary operation. In other words, even though the device is divided into a plurality of separate and discrete chambers, the chambers are interconnected together so that the overall system functions as a unit.

It will be appreciated by those skilled in the art that certain modifications may be made by those devices disclosed without departing from the spirit and scope of the present invention.

What is claimed is:

1. Shock absorbing body protective pads for use by athletes in contact sports and comprising:

(a) a pair of heat sealable plastic film members each having lateral edge surfaces and being arranged in generally superimposed relationship and sealed together, one to the other, along said lateral edge surfaces, and with a plurality of cooperating and interconnected chambers contoured to define an integral body protective pad formed from said pair of edge sealed plastic film members;

(b) each chamber comprising an enclosure with a foam pad constrainably retained therewith, and with the interior volume of at least two chambers being interconnected and in communication with one another through a port means common to said interconnected chambers, and with a plurality of generally rigid tubular exhaust ports communicating between said interconnected chambers and the ambient and being disposed along the said lateral edge surface of said interconnected chambers;

(c) one outer surface of each of said heat sealable film members being adapted to be in contact with the body of the wearer and comprising a layer of woven scrim and with the surface of each of said plastic film members opposed to said one outer surface being fusible and heat sealable;

(d) each of said foam pads comprising a reticulated open cell foam and having a volume substantially equal to the volume of the chamber it occupies and a configuration corresponding to and defining the configuration of its chamber;

(e) each of said interconnecting port means being disposed within the same formed between mutually adjacent chambers and common thereto, and with said mutually interconnected chambers collectively defining a pad segment;

(f) each pad segment having a pair of said generally rigid tubular exhaust ports coupled thereto, with the individual exhaust ports of each pair of exhaust ports being arranged along the lateral edge surfaces of said chamber and being disposed in oppositely disposed spaced apart realtionship; and (g) each of said rigid tubular exhaust ports has opposed inner and outer ends, and wherein the inner end of each is disposed at an acute angle relative to the tubular axis.

2. The shock absorbing body protective pad as defined in claim 1 wherein said acute angle is between 30° and 60°.

* * * * *

UNITED STATES PATENT AND TRADEMARK OFFICE

CERTIFICATE OF CORRECTION

PATENT NO. : 4,991,230

DATED : February 12, 1991

INVENTOR(S) : Eugene J. Vacanti

It is certified that error appears in the above-identified patent and that said Letters Patent is hereby corrected as shown below:

Column 6, line 10, "therewith" should read -- therewithin --. Line 18, "surface" should read -- surfaces --. Line 31, "same" should read -- seam --.

Signed and Sealed this

Thirtieth Day of June, 1992

*Attest:*

DOUGLAS B. COMER

*Attesting Officer*

*Acting Commissioner of Patents and Trademarks*